US005505637A

United States Patent [19]

Krämer et al.

[11] Patent Number: 5,505,637

[45] Date of Patent: Apr. 9, 1996

[54] SHIELDED CONNECTOR WITH HERMAPHRODITIC SHELL

[75] Inventors: Rudolf Krämer, Lautertal; Roland Göpel, Fürth/Odw., both of Germany

[73] Assignee: The Whitaker Corporation, Wilmington, Del.

[21] Appl. No.: 304,327

[22] Filed: Sep. 12, 1994

[30] Foreign Application Priority Data

Oct. 14, 1993 [GB] United Kingdom ..... 9321180

[51] Int. Cl.[6] ..... H01R 9/03

[52] U.S. Cl. ..... 439/610; 439/467

[58] Field of Search ..... 439/607, 610, 439/609, 456, 459, 465, 466, 467, 906

[56] References Cited

U.S. PATENT DOCUMENTS

| | | | |
|---|---|---|---|
| 4,653,836 | 3/1987 | Peele | 439/610 |
| 4,713,023 | 11/1987 | Bixler et al. | 439/610 |
| 4,747,785 | 5/1988 | Roberts et al. | 439/610 |
| 4,916,804 | 4/1990 | Yoshimura et al. | 29/592.1 |
| 5,108,313 | 4/1992 | Adams | 439/610 |
| 5,158,481 | 10/1992 | Frantz | 439/607 |
| 5,195,909 | 3/1993 | Huss, Jr. et al. | 439/610 |

FOREIGN PATENT DOCUMENTS

| | | |
|---|---|---|
| 0080813 | 6/1983 | European Pat. Off. . |
| 0125498 | 11/1983 | European Pat. Off. . |
| WO85/05230 | 11/1985 | WIPO . |

*Primary Examiner*—Gary F. Paumen
*Assistant Examiner*—Hien D. Vu
*Attorney, Agent, or Firm*—Eric J. Groen; A. J. LaRue

[57] ABSTRACT

A shielded electrical connector is comprised of a shielded connector component having a shielding shroud integrated with a front flange section. The shielded connector is positionable within an outer shell including hermaphroditic shielding shell members whereby each shielding shell member includes hook members on opposing sides thereof for inter-engagement at the front of the shell members. Fasteners can then be used to retain the shell members together.

10 Claims, 4 Drawing Sheets

SHIELDED CONNECTOR WITH HERMAPHRODITIC SHELL

BACKGROUND OF THE INVENTION

1. Field of the Invention

The subject invention relates to an outer shell for receipt over a shielded electrical connector where the shielding shells are hermaphroditic.

2. Description of the Prior Art

It is common in telecommunication and/or data connection systems to provide an electrical connector of a Subminiature-D configuration where a shielded electrical connector includes a metal shroud surrounding electrical contacts, where the shroud is provided for EMI/RFI protection and must be commoned to the shielding braid of shielded cable to be terminated to the electrical connector. Typically, the shielded electrical connector is placed within a stamped and formed metal or a cast metal outer housing comprised of two outer shell members. It is desirable to have an effective electrical contact between the outer shell members and both the individual shield on the connector as well as to the cable shielding braid. These shielding shells are typically used as the commoning link between the shielding braid and the individual shield on the connector, and it is often times necessary to make contact also with the outer shielding shell. However it is difficult to provide such an electrical connection with the presently available technology, and at the same time provide an easily installable connection assembly.

SUMMARY OF THE INVENTION

It is an object of the invention then to provide an electrical connector design which provides easy assembly of outer shielding shells over an inner shielded connector assembly.

The objects of the invention have been accomplished by providing an electrical connector assembly comprised of an inner shielded connector and outer shielding shells adapted to encompass the inner shield connector. The assembly is characterized in that the shielding shells have complementary hook members adjacent to one peripheral edge thereof for locking the shell members together, and fastening means adjacent to an opposing peripheral edge of the shell members to retain the shell member together.

Preferably the one peripheral edge is along the front edge thereof, and the opposing peripheral edge is towards the rear of the shell members.

DETAILED DESCRIPTION OF THE PREFERRED EMBODIMENT

Figure 1:
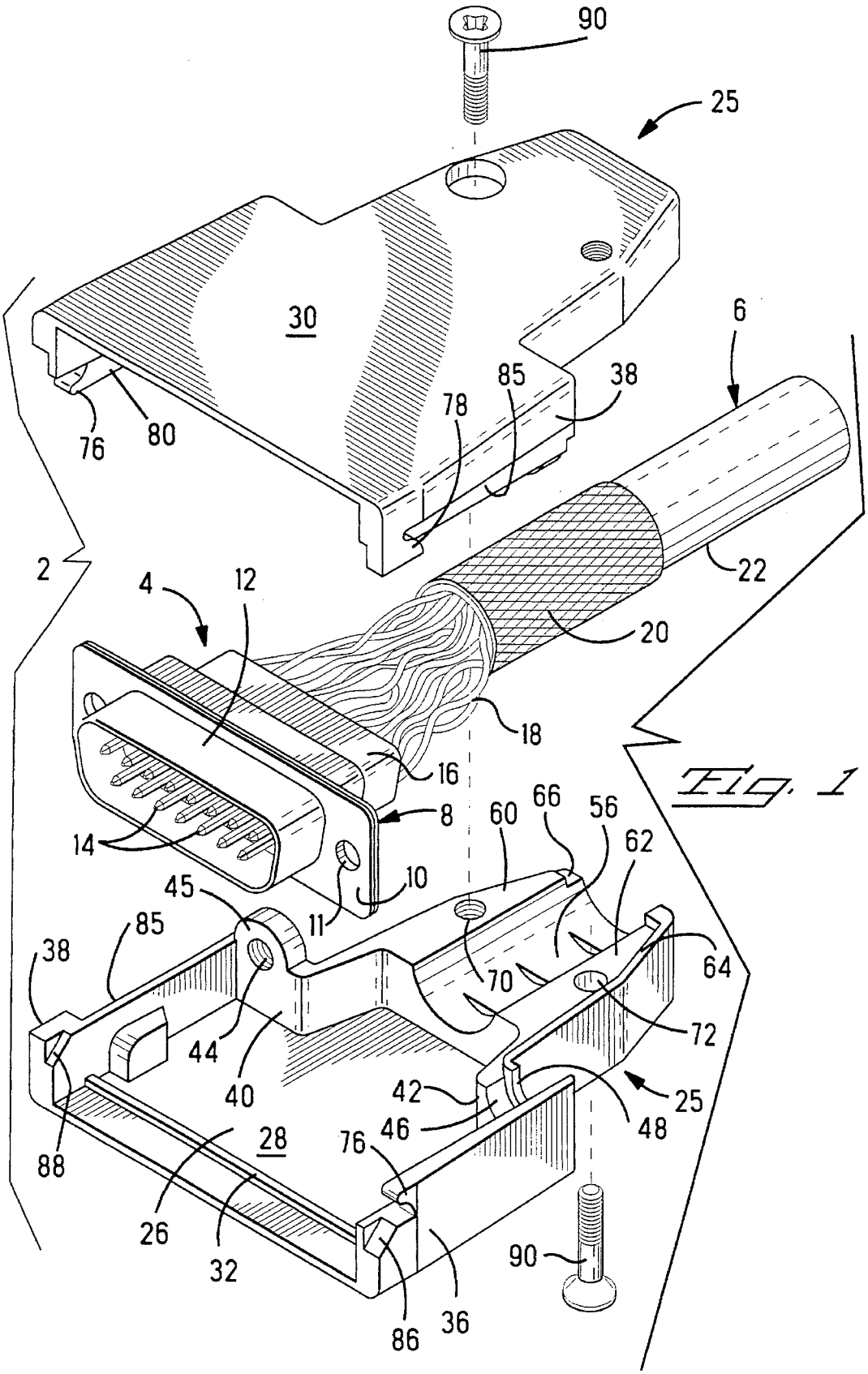
FIG. 1 is an isometric view of the connector assembly shown in an exploded manner ready for assembly with the shielding shells.
Figure 4:
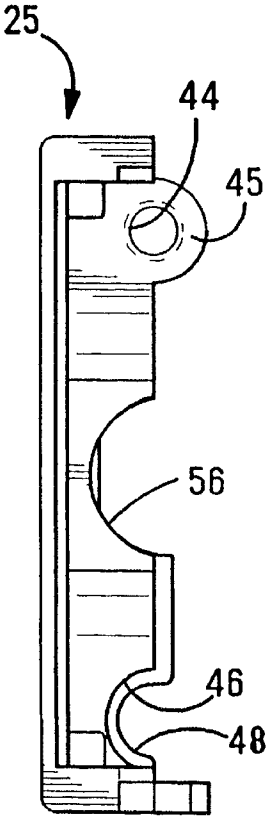
FIG. 4 is a front view of the shell of FIG. 2.

With reference first to FIG. 1, an electrical connector is shown generally at 2, and will be described, which includes an inner shielded connector 4 terminated to electrically shielded cable 6. The electrical connector 4 is a shielded connector assembly similar to that provided by the assignee, and referred to as AMPLIMITE HD-20. The connector 4 is generally comprised of a shield member 8 having a front flange portion 10 having apertures 11, and an integrally formed shielding shroud 12 which forms a D-configuration for polarized interconnection with a corresponding connector. Electrical terminals are shown at 14 which extend through a housing portion 16 and include wire connecting sections (not shown) which could be either insulation displacement contacts or wire crimp contacts, although it is more common to provide insulation displacement contacts on such electrical connectors. The shielded cable 6 includes a plurality of individual insulated wire conductors 18 which can be terminated to the wire connecting sections of the connector 4 and thereby interconnected to corresponding pin terminals 14 of the connector 4. The shielding cable 6 further includes shielding braid 20 which is typically dressed over outer insulation 22 of the shielded cable 6 to assist in making better ground contact.

Figure 2:
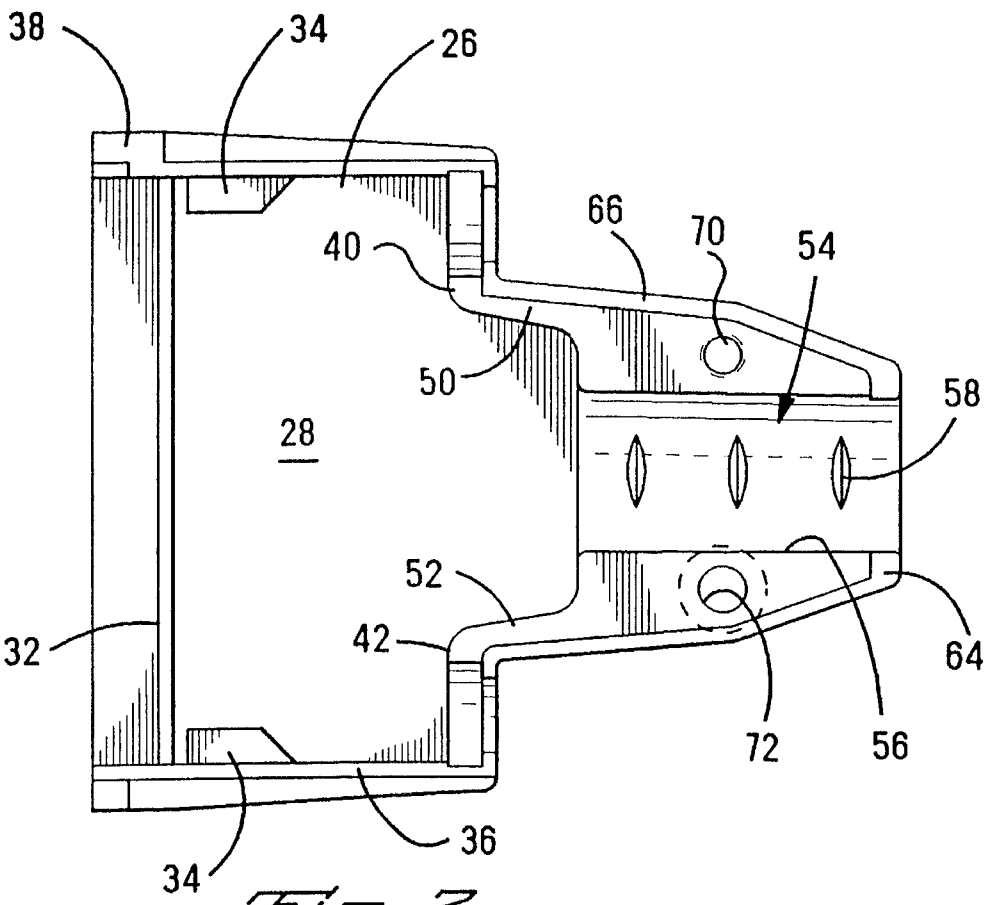
FIG. 2 is an upper plan view of one of the shell halves.
Figure 6:
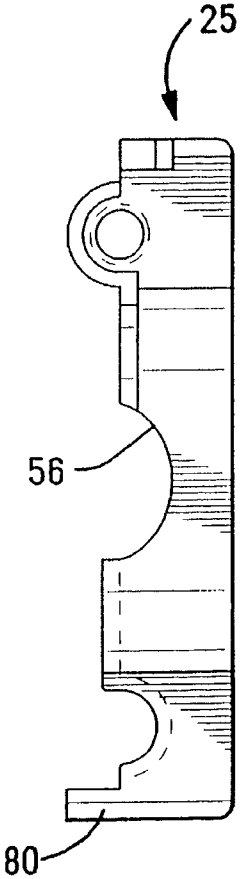
FIG. 6 is an end view of the shell member of that shown in FIG. 2.

With respect now to both FIGS. 1 and 2, an outer shielding shell is shown generally at 25, and it should be appreciated that two identical shielding shells 25 are included, and each half includes corresponding features. The shielding shell 25 includes a base wall 26 having an inner surface 28 and an outer surface 30 (FIG. 1). The inner surface 28 includes a transverse rib 32 proximate to a front end of the shielding shell 25, with a pair of bosses 34 directly behind the transverse rib 32 and positioned against side walls 36,38 as will be described herein. Rear wall sections 40 and 42 extend upwardly from the base wall 26 where rear wall section 40 includes a threaded connection at 44 within a semi-circular boss 45, whereas rear wall section 42 includes a U-shaped receiving section 46 surmounted by a flange section 48. It should be appreciated that the semi-circular boss 45 and the semi-circular recess 46 are at substantially the same axial distance from the front edge of the shielding shell 25 such that the corresponding semi-circular boss 45 of a corresponding shielding shell can reside within and against the semi-circular recess 46. Rearwardly of the rear wall portions 40 and 42 are wall sections 50 and 52 which lead into a cable receiving section shown generally as 54. The cable receiving section includes an axial semi-cylindrical slot 56 having barbs at 58. The cable receiving section 54 further includes upper surfaces 60 and 62, where upper surface 62 includes an exterior rim section 64, while upper surface 60 has on its outer periphery, a corresponding slot 66. The cable receiving section further includes one threaded opening at 70 and one through hole 72.

Figure 3:
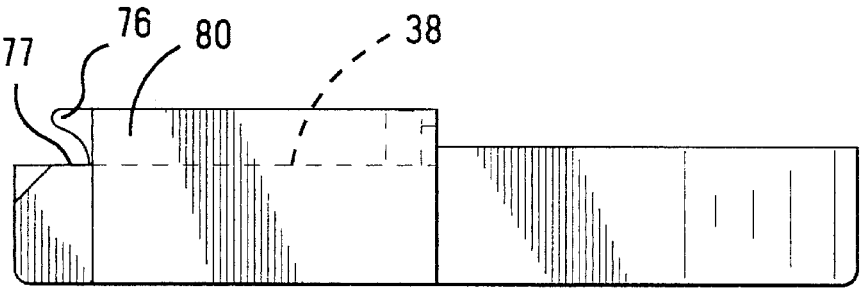
FIG. 3 is a side view of the shell member shown in FIG. 2.
Figure 5:
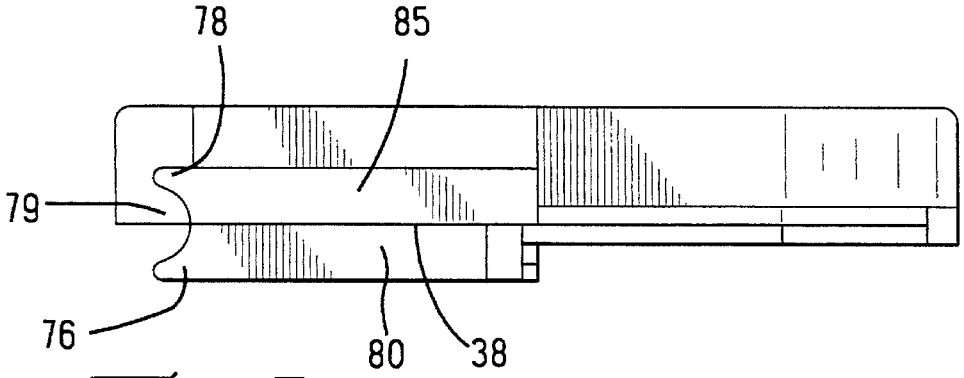
FIG. 5 is the opposite side view of the shell member as that shown in FIG. 3.

Adjacent to the front edge of the shielding shell 25 are a pair of corresponding hook sections 76 and 78 where hook section 78 is profiled at the front of an extension wall 80 which projects above the opposing wall 38, whereas hook section 76 is profiled within the side wall section 38 by way of a reduced thickness section 85. The hook member 76 defines a corresponding slot or opening 77 as best shown in FIG. 3, whereas the hook member 78 defines a slot or opening 79 as best shown in FIG. 5. At the front edge of walls 36,38 are relief surfaces 86,88, as best shown in FIG. 1.

Figure 7:
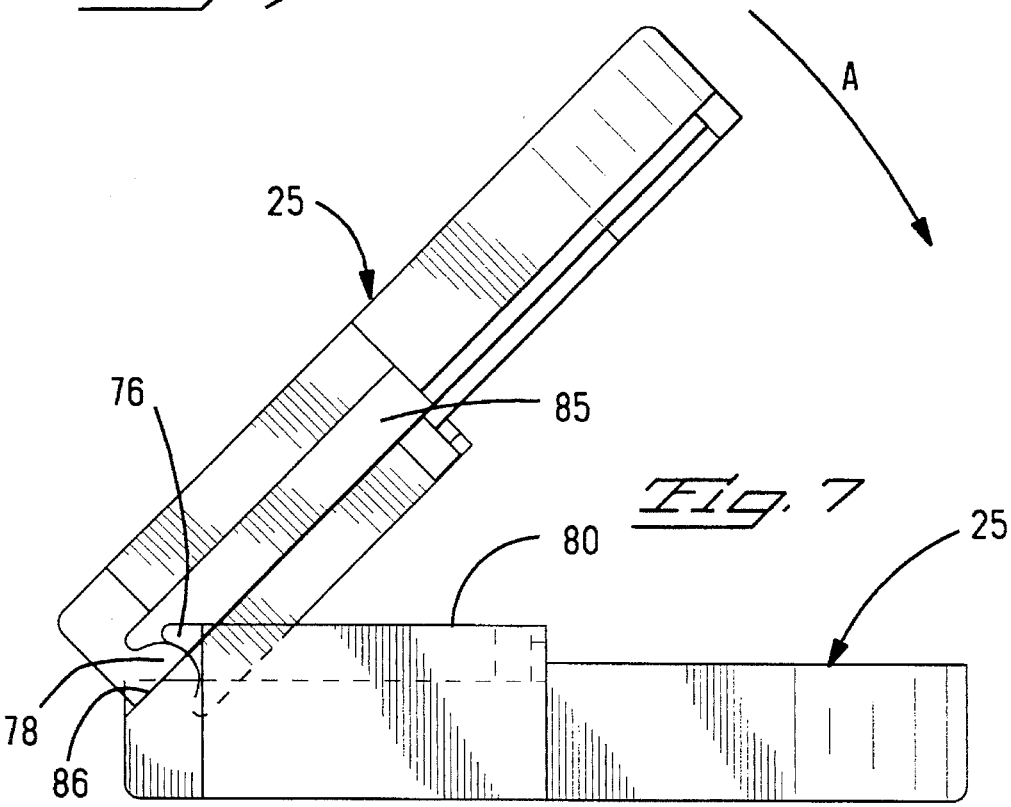
FIG. 7 shows the interengagement of the two shell members.
Figure 8:
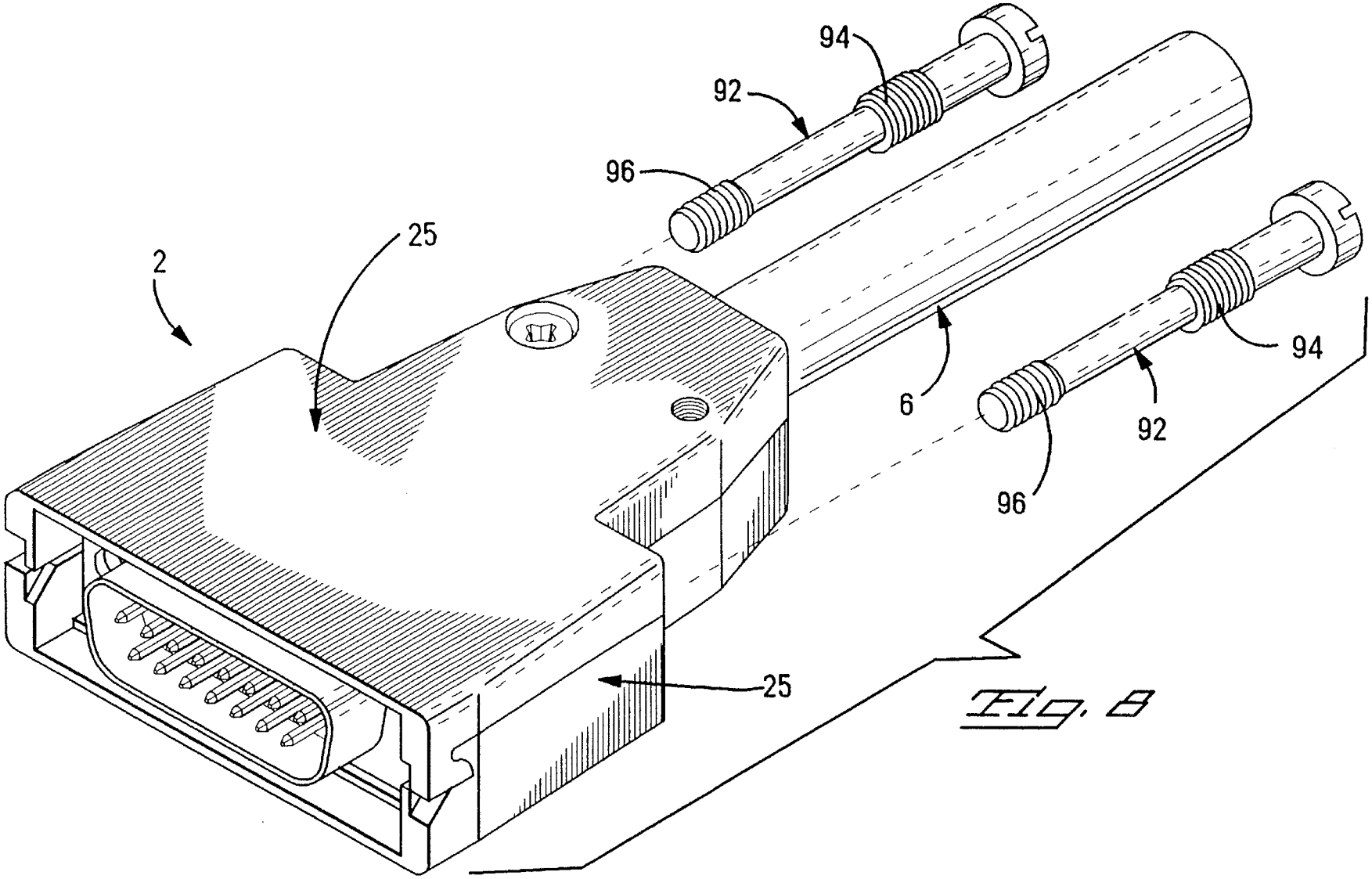
FIG. 8 is an isometric view similar to that of FIG. 1 showing the fully assembled connector.

With the components as described above, the connector can be assembled as follows. The shielded cable 6 can be prepared as shown in FIG. 1 and the individual conductors 18 can be interconnected to the wire connecting sections of terminals 14. The shielding braid 20 can thereafter be dressed over the outer insulation 22 and the shielded cable 6 and connector 4 can be positioned within one shielding shell 25 with the flange portion 10 residing between the transverse rib 32 and the bosses 34. This places the shielding braid 20 within the cylindrical recess 56 and against the barb sections 58. The corresponding shielding shell 25 can be positioned over the connector member 4 as shown in FIG. 7, and can be rotated somewhat in the direction of Arrow A so that hook member 76 is positioned within its corresponding slot 79 and engaging with hook member 78, while hook member 78 resides within its corresponding slot 77 and engages hook member 76. This also places the semi-cylindrical boss member 45 within the semi-cylindrical recess 46 and aligns corresponding apertures 70 and 72. As shown in FIG. 8, threaded fasteners 90 may now be inserted through the aperture 72 and brought into threaded engagement with threaded openings 70. As shown in FIG. 8, threaded fasteners, or jack screws 92 having first and second threaded sections 94 and 96 can be inserted through the threaded openings 44 such that the threaded sections 96 will project through apertures 11 in the flange section 10 and will flank the shroud section 12 for threading engagement with a mating connector.

In the preferred embodiment of the invention, the flange section 10 of the inner connector 4 are commoned together. This commoning could be performed by the mating connector, or could be made by way of clips within the shielding shells 25 which contact the flange member 10. Alternatively, the height of the shielded flange 10, could be somewhat greater than the dimension between opposing surfaces 28, when the shells 25 are closed. Thus, when the shells 25 are fully rotated into position, contact between the shielded connector 4 and the shell members 25 would be ensured by way of the fasteners 90. It should be appreciated from FIG. 7 that the surface 86 and corresponding surface 88 allow relief areas, for the pivotal movement of the two shell members 25.

We claim:

1. An electrical connector assembly comprising an inner connector having at least one contact therein and a flange extending outwardly therefrom, an outer shell of hermaphroditic shell members surrounding the inner connector, each of said hermaphroditic shell members having a forwardly-facing open hook member and a rearwardly-facing open hook member along opposing side walls, said hook members being constructed to be complementary engaging so that the forwardly facing hook member of one of the shell members is engaged with the rearwardly facing hook member of the other of the shell members, and a fastener for retaining the shell members together about the inner connector.

2. The electrical connector assembly of claim 1, wherein the outer shell is conductive.

3. The electrical connector assembly of claim 1 or claim 2, wherein the shell halves each include a ledge for abutting the flange to retain the inner connector in position.

4. The electrical connector assembly of claim 1, wherein the shell members include a semi-cylindrical slot opposite the hook members that form a cable receiving section in communication with the inner connector when the shell members are assembled.

5. The electrical connector assembly of claim 1, wherein forward of the forwardly-facing open hook member and the reawardly-facing open hook member relief surfaces are provided for pivotal opening of the shell members in clam shell fashion about the engaged hook members.

6. A shell for covering an electrical connector having a flange thereon, said shell comprising;

hermaphroditic shell members profiled to cover the electrical connector when the shell members are engaged with one another;

the shell members having forwardly-facing hook members and rearwardly-facing hook members at opposing side walls adjacent front ends thereby enabling the hook members of said shell members to complementarily engage each other and enclose the electrical connector therein upon the shell members being engaged together with the hook members maintaining the front ends of the shell members in engagement; and a fastener spaced from the front ends securing the shell members together about the electrical connector.

7. A shell as claimed in claim 6, wherein the complementarily-engaged hook members define a pivot.

8. A shell as claimed in claim 6, wherein alignment members are located on inside surfaces of the shell members for engagement by the flange of the electrical connector within the shell members.

9. A shell as claimed in claim 6, wherein the shell members include semi-cylindrical recesses along which an electrical cable extends.

10. A shell as claimed in claim 6, wherein the shell members have rear wall sections, one of the rear wall sections having a semi-circular boss and the other of the rear wall sections having a semi-circular recess whereby the semi-circular boss of each of the shell members complementarily engages the semi-circular recess when the shell members are engaged.

* * * * *